US009032604B2

(12) United States Patent
High

(10) Patent No.: US 9,032,604 B2
(45) Date of Patent: May 19, 2015

(54) CARGO DOOR SAFETY TOOL

(71) Applicant: Keith Steven High, Auburn, IN (US)

(72) Inventor: Keith Steven High, Auburn, IN (US)

( * ) Notice: Subject to any disclaimer, the term of this patent is extended or adjusted under 35 U.S.C. 154(b) by 265 days.

(21) Appl. No.: 13/644,348

(22) Filed: Oct. 4, 2012

(65) Prior Publication Data

US 2013/0086845 A1 Apr. 11, 2013

Related U.S. Application Data

(60) Provisional application No. 61/543,600, filed on Oct. 5, 2011.

(51) Int. Cl.
*B66F 15/00* (2006.01)

(52) U.S. Cl.
CPC ..... *B66F 15/00* (2013.01)

(58) Field of Classification Search
USPC ..... 81/15.9, 484, 488; 7/166; 29/426.5, 29/244, 240; 254/21, 25, 131
See application file for complete search history.

(56) References Cited

U.S. PATENT DOCUMENTS 5,425,154 A * 6/1995 Edwards, Jr. ..... 16/436
6,058,809 A * 5/2000 Flanz ..... 81/45
6,659,697 B1 * 12/2003 Guenther ..... 410/103
2007/0096473 A1 * 5/2007 Ortega ..... 292/1
2008/0012356 A1 * 1/2008 Lugo ..... 292/218
2013/0247351 A1 * 9/2013 Stutson, Jr. ..... 81/15.9

OTHER PUBLICATIONS

ANCRA International, "Ergo 360 Bar, The Solution You've Been Waiting For", 2 pages, Nov. 2011.

* cited by examiner

*Primary Examiner* — Hadi Shakeri
(74) *Attorney, Agent, or Firm* — Faegre Baker Daniels LLP

(57) ABSTRACT

A safety tool is specifically adapted to aid in opening hinged rear doors of industrial containers safely, while also ensuring that the operator of the safety tool remain outside the potential zone of danger whenever the rear door has the potential to swing open. The present safety tool not only provides convenience and leverage for commonly performed door opening procedures, but also ensures that the operator's body and hands remain safely distanced from the direction of door travel and the potential discharge path of material contained within the cargo box. In addition, the present safety tool is lightweight and compact, allowing the tool to be easily stowed in or around a cargo box and/or truck to and thereby ensure that the safety tool is available whenever it may be needed to aid in opening and/or closing the cargo box door.

24 Claims, 10 Drawing Sheets

CARGO DOOR SAFETY TOOL

CROSS REFERENCE TO RELATED APPLICATION

This application claims the benefit under Title 35, U.S.C. §119(e) of U.S. Provisional Patent Application Ser. No. 61/543,600 filed Oct. 5, 2011, the entire disclosure of which is hereby expressly incorporated by reference herein.

BACKGROUND

1. Technical Field

The present disclosure relates to a tool used to safely open cargo doors, and in particular, to a tool adapted to safely open industrial strength hinged doors of the type commonly found in cargo trucks.

2. Description of the Related Art

Cargo trucks typically include a door at the rear opening of the cargo box to selectively prevent or allow access to the contents carried inside. In the case of industrial cargo trucks used for hauling bulk materials, such as dump trucks, the doors at the rear of the cargo box may be made from heavy duty materials, such as heavy gauge steel, to ensure that contained materials are secure within the cargo box during transport.

FIGS. 8 and 9 illustrate dump truck 100 in a cargo transport configuration (FIG. 8) and a contents-discharging configuration (FIG. 9). In industrial applications, such as in the construction and waste hauling industries, cargo box 110 mounted to dump truck 100 is made from heavy gauge steel such that cargo box 110 can be used to contain, transport and discharge large quantities of heavy bulk materials, such as gravel, building materials, earthen materials, steel and the like. As noted above, these industrial applications may provide a rear door 112 made from a similarly heavy-duty material having comparable strength to the walls and floor of cargo box 110.

In use, dump truck 100 may collect cargo material M within cavity 114 of cargo box 110 at a cargo collection site, such as a raw materials manufacturer. In many cases, material M is loaded from above cargo box 110 using, e.g., a crane, front loader, elevator or other overhead loading device. During such loading from above, rear door 112 of cargo box 110 remains in the closed position shown in FIG. 8 to ensure containment of material M within cavity 114.

With material M contained in cargo box 110 and rear door 112 closed, dump truck 100 can be driven to the delivery site where material M is needed. At the delivery site, cargo box 110 can be elevated to utilize a gravity assist in discharging material M via door 112. Alternatively, cargo box 110 can be lowered from truck 100 by sliding cargo box off of the truck frame while in the elevated configuration of FIG. 9, such that rollers 162 (see, e.g., FIGS. 10 and 12-15) contacting and roll along the ground as cargo box 110 slides away from truck 100.

To discharge material M from cavity 114, door 112 is opened and the front of cargo box 110 is elevated such that cargo box 110 pivots about a pivot point near the rear of cargo box 110 and underneath rear door 112. As shown in FIG. 9, this reconfiguration of cargo box 110 into the discharge position causes material M to dump or fall out of cavity 114. However, material M may also be discharged when cargo box is horizontal as shown in FIG. 8, or when cargo box 110 is on the ground as described above.

In many instances, door 112 is manually opened by an operator at the delivery site. In the case of cargo box 110 shown in FIGS. 8 and 9, rear door 112 pivots about a vertical axis passing through door hinges 116 (FIG. 8). When cargo box is substantially filled with material M, and/or when material M shifts rearwardly during transport, a substantial amount of pressure may build up upon the inner surface of rear door 112. This pressure is released upon the opening of rear door 112, sometimes with significant force and suddenness.

To protect the operator responsible for opening rear door 112, latch mechanism 118 is disposed along sidewall 120 of cargo box 110 such that actuation of latch mechanism 118 is performed out of the swing path (i.e., "door sweep") of rear door 112 and away from the direction of material discharge from cavity 114. However, the substantial weight of rear door 112, combined with large and occasionally uneven pressures exerted upon rear door 112 by material M, can potentially cause rear door 112 to bind in the closed position even when latch mechanism 118 has been opened. When such binding occurs, the operator must improvise a way to exert additional opening force on rear door 112. In some cases, the operator may place him or herself into the opening path of door 112 and/or the potential discharge flow path of material M in seeking to exert such additional force. In so doing, the worker may expose him or herself to injury.

SUMMARY

The present disclosure provides a safety tool specifically adapted to aid in opening hinged rear doors of industrial containers safely, while also ensuring that the operator of the safety tool remain outside the potential zone of danger whenever the rear door has the potential to swing open. The present safety tool not only provides convenience and leverage for commonly performed door opening procedures, but also ensures that the operator's body and hands remain safely distanced from the direction of door travel and the potential discharge path of material contained within the cargo box. In addition, the present safety tool is lightweight and compact, allowing the tool to be easily stowed in or around a cargo box and/or truck to and thereby ensure that the safety tool is available whenever it may be needed to aid in opening and/or closing the cargo box door.

In one form thereof, the present disclosure provides a method of safely manipulating a door of a cargo box through the use of a safety tool, the method including: rotatably affixing the safety tool to a lever of a latch mechanism by passing an open distal end of the safety tool over the lever, the latch mechanism operable to prevent or allow opening of the door based on a pivotal configuration of the lever; disengaging the latch mechanism from the door by pivoting the lever of the latch mechanism via the safety tool, the step of disengaging accomplished with a user of the safety tool spaced from the sweep of the door and from a direction of potential flow of material outwardly from the cargo box via the door; inserting a distal edge of a lever plate disposed at a distal end of the safety tool into a gap between the door and a sidewall of the cargo box, such that the safety tool extends away from the gap along a direction opposed to the sweep of the door; and levering the door toward an open position by applying a force to the safety tool, the step of levering accomplished with the user of the safety tool spaced from the sweep of the door and from the direction of potential flow of material outwardly from the cargo box via the door.

In another form thereof, the present disclosure provides a safety tool including: an elongate structure defining a tool longitudinal axis and an outer surface, the elongate structure having an open end at one of a proximal axial end and a distal axial end, the open end sized and configured to receive a lever of a latch mechanism; a handle affixed to the proximal axial end of the elongate structure, the handle defining a handle longitudinal axis substantially perpendicular to the tool longitudinal axis; and a lever plate affixed to the distal axial end of the elongate structure, the lever plate including: a proximal portion abutting and affixed to the outer surface, the proximal portion defining a plate-like structure substantially parallel to the tool longitudinal axis; and a distal portion angled with respect to the tool longitudinal axis and extending distally away from the distal axial end of the elongate structure, the elongate structure, the handle and the lever plate all affixed to one another such that the safety tool comprises a rigid monolithic structure capable of transmitting force and torque from the handle to the lever plate via the elongate structure.

In yet another form thereof, the present disclosure provides a safety tool for performing operations related to the opening of a rear door of a cargo box, the safety tool including: a pin removal means for loosening or removing a safety pin from a bore formed in the rear door; a safety chain disengagement means for disengaging a safety chain from a safety chain hook; and a latch mechanism actuation means for pivoting a latch mechanism lever between engaged and disengaged configurations.

BRIEF DESCRIPTION OF THE DRAWINGS

The above-mentioned and other features and advantages of this disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION

Figure 1:
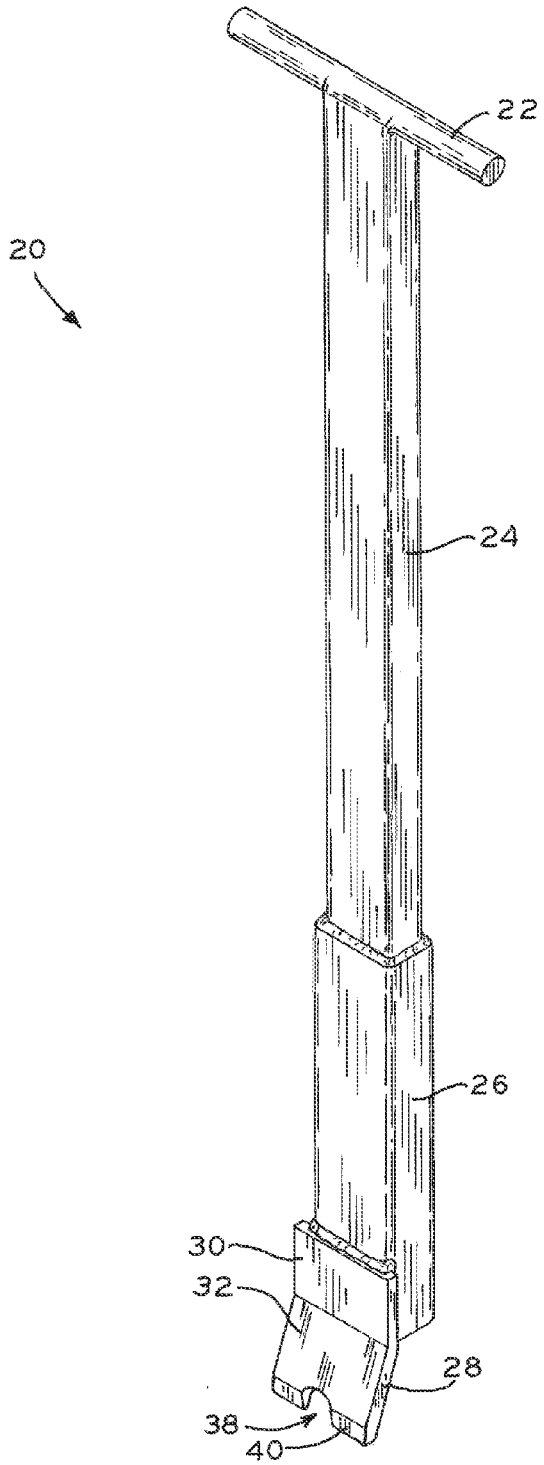
FIG. 1 is a perspective view of a safety tool made in accordance with the present disclosure.
Figure 3:
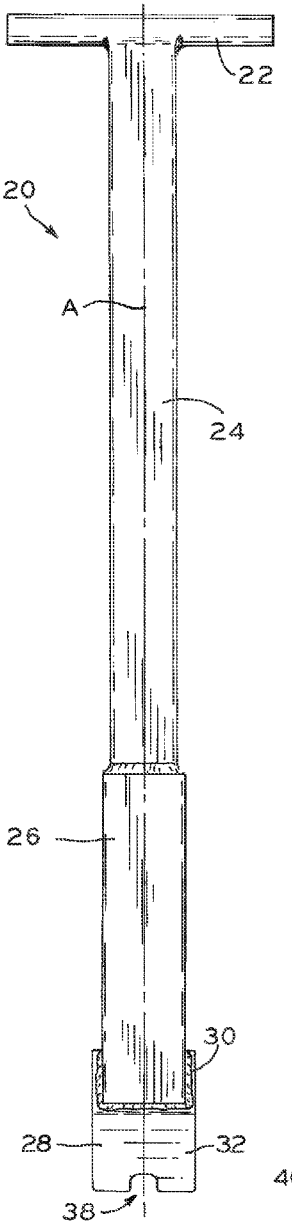
FIG. 3 is a rear elevation view of the safety tool shown in FIG. 1.
Figure 4:
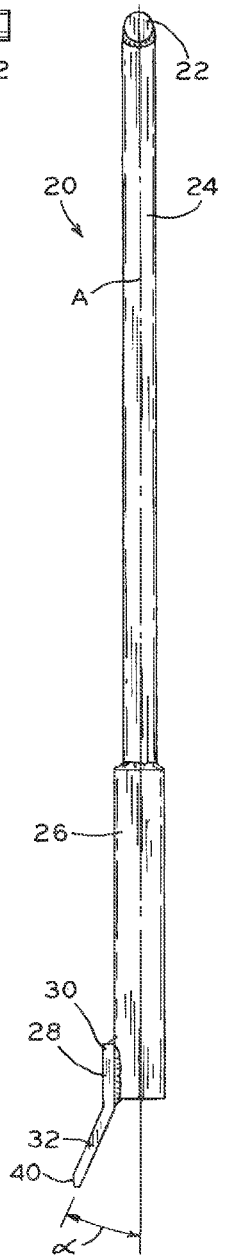
FIG. 4 is a right side elevation view of the safety tool shown in FIG. 1, it being understood that the left side elevation view is a mirror image of the right side elevation view.
Figure 5:
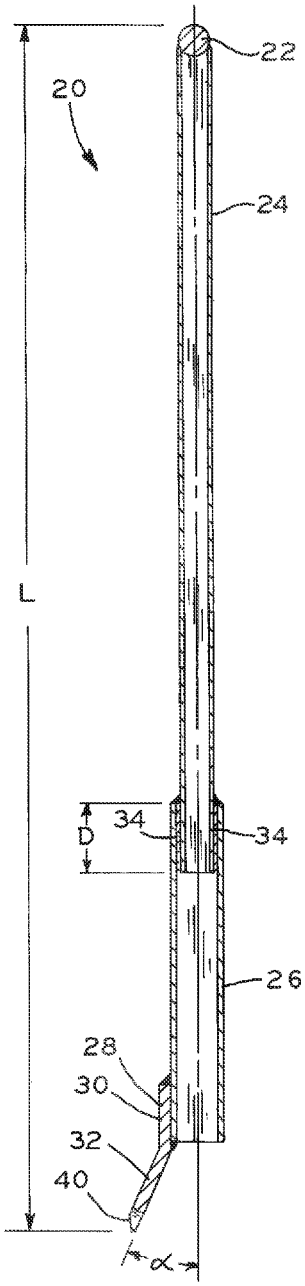
FIG. 5 is a cross-sectional, elevation view of the safety tool shown in FIG. 1, taken along line 5-5 of FIG. 2.
Figure 6:
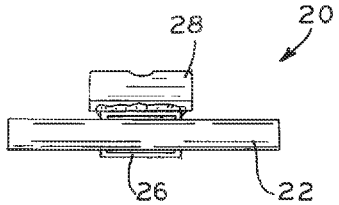
FIG. 6 is a top plan view of the safety tool shown in FIG. 1.

Turning now to FIG. 1, an overall perspective view of safety tool 20 is shown. As best seen in FIGS. 3 and 4, proximal tube 24 and distal tube 26 cooperate to form the overall lever-like structure forming the body of safety handle 20, and together define longitudinal axis A extending along the geometric centers of proximal and distal tubes 24, 26. Handle 22 is connected to a proximal end of proximal tube 24 to form a T-shaped structure, with a longitudinal axis of handle 22 substantially perpendicular to longitudinal axis A of safety tool 20. Lever plate 28 is disposed at a distal end of distal tube 26 and connected to a sidewall thereof, and extends distally away from the distal terminal end of distal tube 26 (as measured along longitudinal axis A) while also angling away from longitudinal axis A. In an exemplary embodiment, a proximal portion 30 of lever plate 28 is a plate-like structure that is substantially parallel to the adjacent sidewall of distal tube 26, while distal portion 32 of lever plate 28 forms angle a with axis A, as illustrated in FIGS. 4 and 5. As discussed in detail below, the angled arrangement of distal portion 32 of lever plate 28 cooperates with the location and configuration of lever plate 28 to provide multiple functions in the manipulation of rear door 112 and related structures using safety tool 20.

Figure 2:
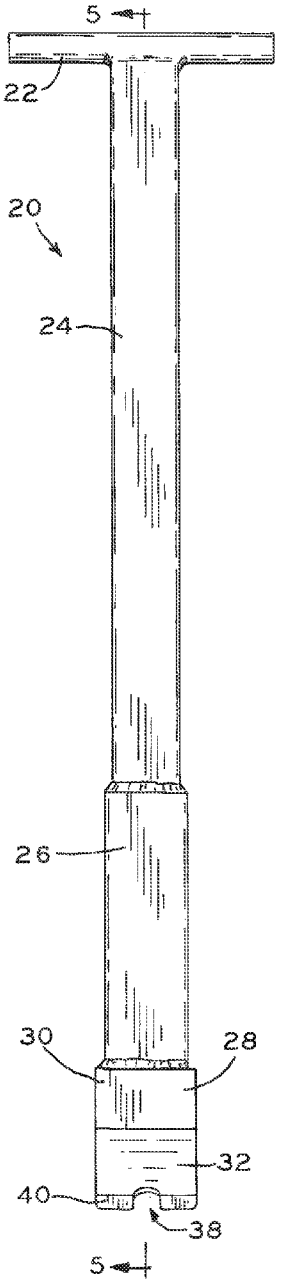
FIG. 2 is a front elevation view of the safety tool shown in FIG. 1.

In an exemplary embodiment, handle 22 is welded to the proximal end of proximal tube 24. The distal end of proximal tube 24 is received within and extends into the proximal end of distal tube 26 by a distance D (FIG. 5). Distance D is sufficient to ensure full transfer of torque and force from proximal tube 24 to distal tube 26 during use, as discussed in detail below. Proximal tube 24 is welded to the proximal end of distal tube 26 at this location, thereby affixing proximal and distal tubes 24, 26 to one another. Lever plate 28 abuts an outer surface of distal tube 26 near the distal end thereof, as shown in FIGS. 2-4. In an exemplary embodiment, lever plate 28 is welded to distal tube 26 to affix lever plate 28 to distal tube 26 is this abutting position.

Welding is an exemplary and effective method of joining handle 22, proximal and distal tubes 24, 26 and lever plate 28, such that safety tool 20 becomes a single rigid monolithic structure with no parts detachable from the structure. However, it is appreciated that other methods of joining the various parts of safety tool 20 may be employed within the scope of the present disclosure, such as fasteners, press or interference fits, and the like. In addition, it is contemplated that safety tool 20 could be created as a single, monolithic part without any pre-assembly or welding, such by casting, molding or 3D printing methods, for example.

In an exemplary embodiment, the overall length L (FIG. 5) of safety tool 20, measured along axis A, is about 3 feet, or more particularly 35.75 inches. In this exemplary embodiment, proximal tube 24 is a hollow rectangular steel tube having outside dimensions of 1 inch by 2 inches and a wall thickness of 0.063 inches. Handle 22 may be formed from a piece of round solid bar stock having a diameter of ⅞ inch or 1 inch, such that the cylindrical outer surface of handle 22 is substantially tangent to the wide (i.e., 2 inch) face of proximal tube 24 after assembly and welding. In this exemplary embodiment, handle 22 is approximately 8 inches long, thereby providing sufficient length to grip handle 22 with two hands during use of safety tool 20.

Distal tube 26 may also be formed from a length of rectangular tube stock. In the above-described exemplary embodiment, distal tube has outer dimensions of 1.5 inches by 2.5 inches and a wall thickness of 0.063 inches. This larger cross-sectional size of distal tube 26 facilitates a firmly grasp by the user during use, while the relatively smaller size of proximal tube 24 reduces the overall weight and size of safety tool 20 in the area of tool 20 that is less likely to be grasped during use. In this exemplary embodiment, the axial length of distal tube 26 is approximately 10 inches to provide for a firm grasp thereof by the user at multiple different positions along axis A.

Continuing with specifications of the above exemplary embodiment, lever plate 28 is formed from a plate 3 inches wide (i.e., along a direction perpendicular to axis A) and about 4.25 inches long, and includes a bend formed about 2.5 inches from the distal edge of lever plate 28 to form angle a (FIGS. 4 and 5). Lever plate 28 is centered on an outer surface of distal tube 26 along the wide dimension thereof (i.e., along one of the 2.5 inch faces). In the exemplary embodiment disclosed herein, lever plate 28 has a thickness of about 5/16 inch to provide substantial strength, as well as to facilitate use of safety tool 20 as a wedge to open a gap between door 112 and cargo box 110 (as described in detail below).

Figure 7:
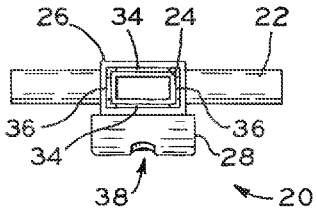
FIG. 7 is a bottom plan view of the safety tool shown in FIG. 1.

Continuing further with specifications of the above exemplary embodiment, distance D of overlap between the distal portion of proximal tube 24 and the proximal portion of distal tube 26 (FIG. 5) is equal to about 2 inches, which is large enough to ensure full transfer of force and torque exerted upon handle 22 to distal tube 26 via proximal tube 24, and small enough to avoid any unnecessary additional weight of safety tool 20. Because the outer periphery of proximal tube 24 is smaller than the inner periphery of distal tube 26, small gaps are formed between adjacent surfaces thereof when proximal tube is inserted into distal tube 26. In order to fill these gaps, shims 34, 36 may be placed in abutting contact with the outer surfaces of proximal tube 24 and the inner surfaces of distal tube 26 (as shown in FIGS. 5 and 7). Shims 34, 36 further prevent any relative movement between tubes 24, 26 and enhance the potential for full transfer of torque and force between handle 22, tubes 24, 26 and lever plate 28.

The present exemplary embodiment, when made from carbon steel components, weighs about 7 lbs. and is therefore easily carried and manipulated by a user. Alternatively, aluminum components may be used to bring the overall weight of safety tool 20 to less than 5 lbs. However, it is contemplated that other sizes, materials and structures maybe used within the scope of the present disclosure as required or desired for a particular application. For example, where additional weight can be tolerated and additional strength is desired, the size and/or thickness of handle 22, tubes 24, 26 and/or lever plate 28 may be increased. Where size is desired to be minimized while preserving substantial strength, proximal and distal tubes 24, 26 may be formed from a single, monolithic solid bar or from a single thick walled tube, for example.

As illustrated in FIGS. 1-5, lever plate 28 includes notch 38, which in an exemplary embodiment forms a half circle centered along the distal edge of distal portion 32 of lever plate 28 and having a radius of about ⅞ inch. In addition, this distal edge includes a tapered portion 40 extending across the width of lever plate 28, interrupted by intersecting notch 38. As described in detail below, notch 38 and taper 40 facilitate the use of safety tool 20 in various tasks relating to manipulation of door 112 during the opening procedure thereof.

Figure 8:
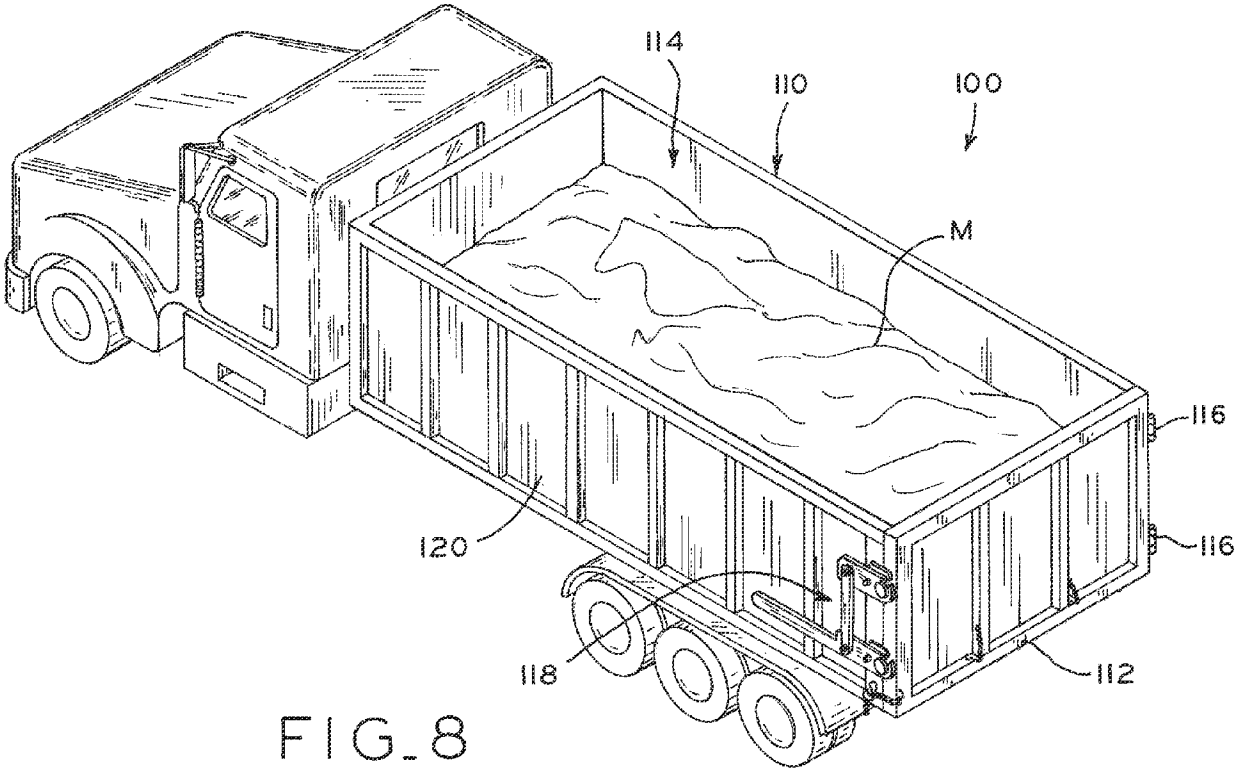
FIG 8 PRIOR ART
FIG. 8 is a perspective view of a dump truck having an attached cargo box in accordance with the present disclosure, with the cargo box shown in a material containment/transport configuration.
Figure 10:
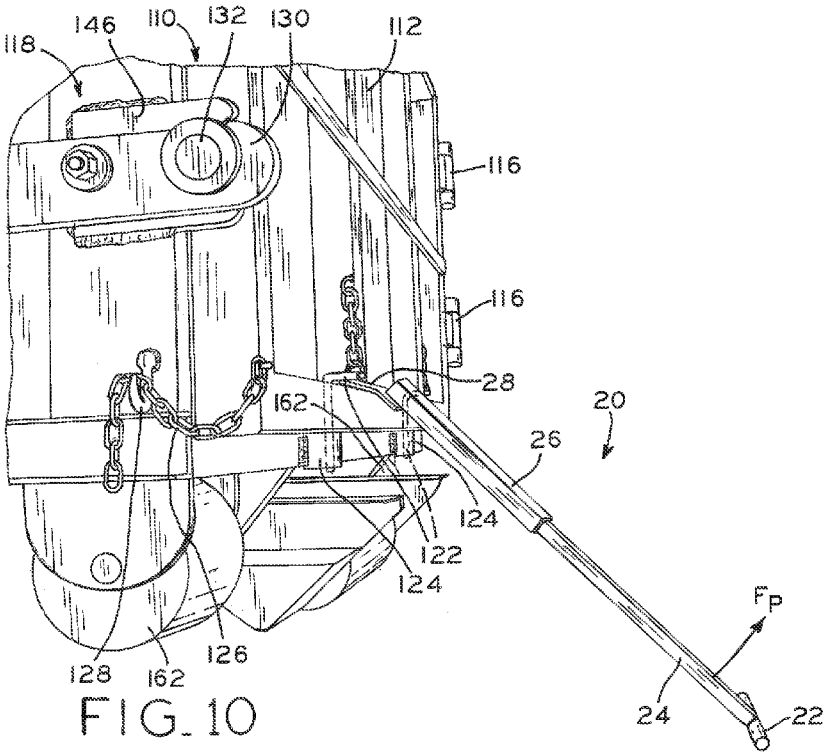
FIG. 10 is a partial, rear perspective view of the cargo box shown in FIG. 8, illustrating use of the safety tool shown in FIG. 1 to remove a latch pin.

Various functionalities and methods of use for safety tool 20 will now be described with reference to FIGS. 10-18. Turning to FIGS. 8 and 10, rear door 112 of cargo box 110 is shown in the fully closed, locked and secured configuration. In this configuration, one or more safety pins 122 (FIG. 10) are received in corresponding bores formed in door 112 and in safety pin brackets 124 affixed to the frame of cargo box 110, thereby preventing pivoting of rear door 112 into the open position. As described below, removal of pins 122 removes this barrier to opening movement.

In addition, an auxiliary safety chain 126 is affixed to rear door 112 and received within safety chain hook 128, thereby also affixing safety chain 126 to sidewall 120 of cargo box 110 (i.e., the sidewall to which hook 128 is affixed). Safety chain 126 therefore prevents opening of door 112 when connected to hook 128 in the illustrated connected position of FIG. 10, while allowing such opening when safety chain 126 is disconnected from hook 128.

Still further, main latching mechanism 118 is illustrated in a locked configuration in FIG. 10. In this locked configuration, latch boss 132 (affixed to rear door 112) is received within latch hooks 130 of latch mechanism 118, thereby preventing any pivoting motion of rear door 112 about door hinges 116. As described below, latch mechanism is configurable into a disengaged position which allows door 112 to pivot open.

With the above mentioned mechanisms in place and secured, rear door 112 is triple secured against opening. With door 112 redundantly secured in the closed position, dump truck 100 having cargo box 110 (FIG. 8) can be loaded with material M and can transport material M as needed while ensuring containment of material M within cavity 114 of cargo box 110.

Figure 9:
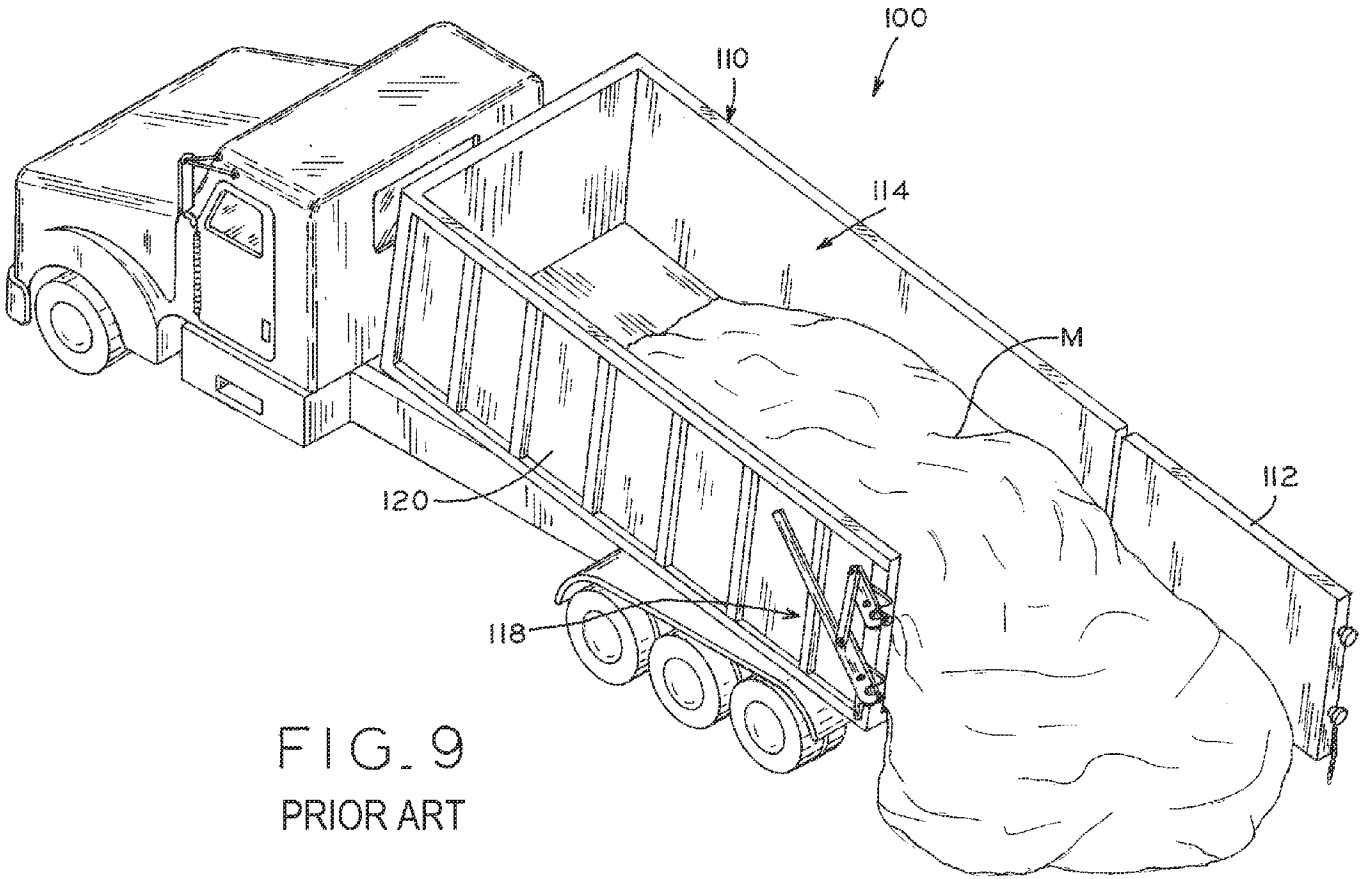
FIG. 9 PRIOR ART
FIG. 9 is a perspective view of the dump truck and cargo box shown in FIG. 8, with the cargo box shown in a material discharge configuration.

When dump truck 100 arrives at its destination and a determination is made to discharge material M from cavity 114 of cargo box 110, each of the above described safety/closure mechanisms must be disengaged to allow rear door 112 to pivot about door hinges 116 into the open configuration as shown in FIG. 9.

Figure 11:
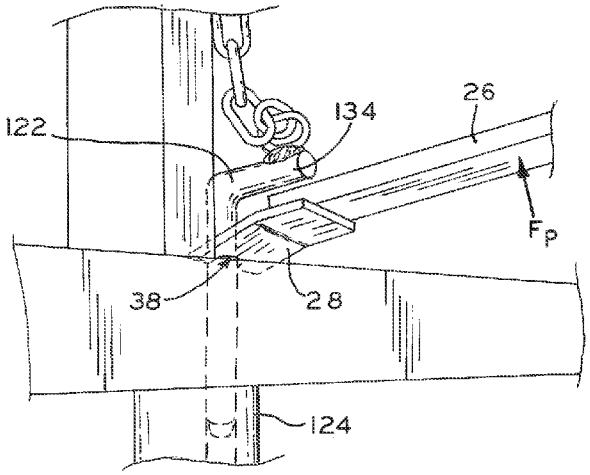
FIG. 11 is an enlarged view of a portion of FIG. 10, illustrating disengagement of a latch pin during the removal process.

Normally, a first step toward opening rear door 112 is to remove safety pins 122. However, pressure on rear door 112 from material M and/or eventual material deformation or degradation in the bores which receive pins 122 may result in a high level of friction between pins 122 and door 112 and/or pin blocks 124. As illustrated in FIGS. 10 and 11, safety tool 20 may be utilized to provide the requisite leverage to free pin 122 from pin block 124. Starting with lever plate 28 facing down (i.e., such that proximal and distal tubes 24, 26 are positioned above lever plate 28 as shown in FIG. 10), lever plate 28 is inserted between the L-shaped protrusion 134 of pin 122 and the adjacent horizontal surface of the door reinforcement rib. As noted above, lever plate 28 may include taper 40 (FIG. 1), which presents a less blunt and relatively sharp leading edge to facilitate initial insertion of lever plate 28 when the L-shaped portion of pin 122 is close to or abutting the adjacent surface of door 112.

In addition, the shaft of safety pin 122 may be received within notch 38 formed in lever plate 28 (FIG. 1) to facilitate full engagement of lever plate 28 with the surrounding structures. With lever plate 28 fully engaged with safety pin 122, force $F_P$ (FIG. 10) is applied to handle 22 and/or one of proximal and distal tubes 24, 26 in order to pivot safety tool 20 upwardly about the point of engagement between safety pin 122 and lever plate 28. As such pivoting occurs, the leading, distal edge of lever plate 28 advances upwardly, i.e., along the direction of removal of pin 112, carrying pin 112 upwardly and out of the locked position. Because the hinge point of the lever action applied by such pivoting is at or near the bend between proximal and distal portions 30, 32 of lever plate 28 (FIG. 1), a substantial mechanical advantage is made available to free safety pin 122 from pin block 124 with a relatively small force $F_P$. With pins (s) 112 so removed, pin(s) no longer present an impediment to movement of rear door 112 with respect to the adjacent structures of cargo box 110 presented by safety pin 122.

At this point in the door-opening procedure, latch mechanism 118 and safety chain 126 are the two remaining structures preventing rear door 112 from swinging open. Accordingly, disengagement of either latch mechanism 118 or safety chain 126 will eliminate redundancy of such safety mechanisms, leaving only one remaining before rear door 112 is free to open. An emphasis on safety of the operator dictates that from this point forward, the operator should remain next to sidewall 120 of cargo box 110, and therefore away from the opening sweep of rear door 112 and the potential flow of material M discharging from cavity 114 once rear door 112 is opened.

Figure 12:
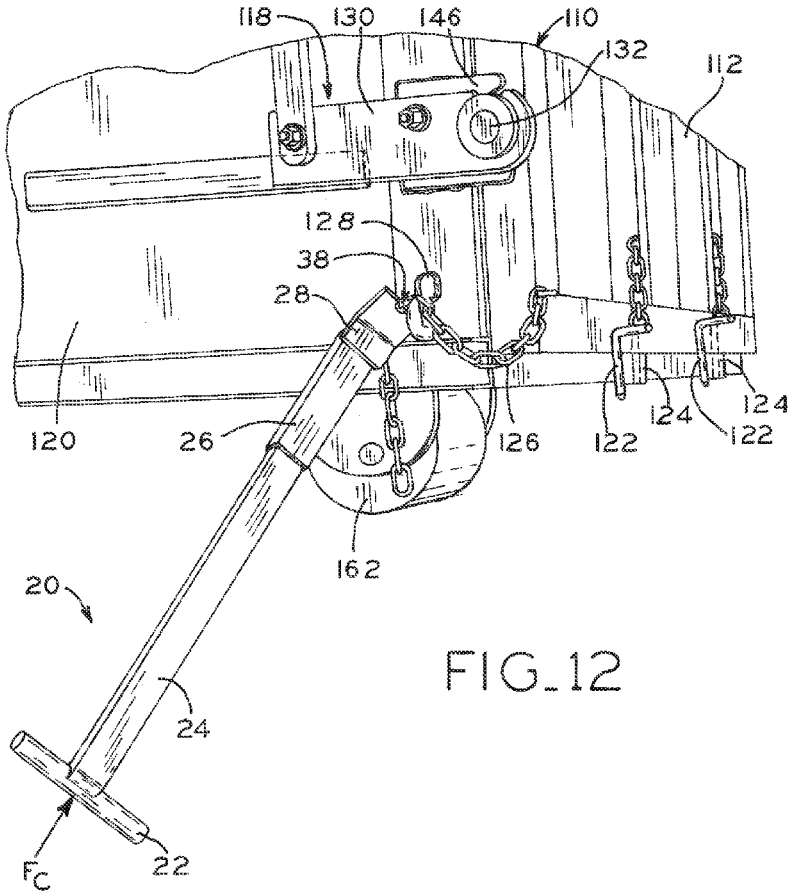
FIG. 12 is a rear, perspective view of the cargo box shown in FIG. 8, illustrating use of the safety tool shown in FIG. 1 for disconnection of a safety chain.

The next step in the opening procedure is normally removal of safety chain 126, which leaves only the primary latch mechanism 118 left for disengagement prior to freeing rear door 112 to pivot about door hinges 116. To remove safety chain 126, safety tool 20 can be employed to dislodge safety chain 26 from safety chain hook 128 as shown in FIG. 12. Standing in the vicinity of sidewall 120 of cargo box 110, the operator can grasp safety tool 20 by handle 22 and distal tube 26, which facilitates a firm grasp and reliable control of safety tool 20. However, the user may grasp any convenient part of safety tool 20 as needed for this step. Notch 38, formed in lever plate 28 as discussed above, can then be engaged with a link of safety chain 126 in the vicinity of hook 128 such that the engaged safety chain link is at least partially captured by lever plate 28. Still standing near sidewall 120 and with hands spaced away from safety chain 126 and hook 128, the user may then apply force $F_C$ in a generally upward and rearward direction to dislodge safety chain 126 from hook 128. In an exemplary method, force $F_C$ is applied substantially along longitudinal axis A (FIGS. 3 and 4) of safety tool 20, which in turn provides optimal force transfer of force $F_C$ via tubes 24, 26. In this procedure, the operator's hands are kept well free and distanced from rear door 112. If door 112 were to open suddenly upon disconnection of safety chain 126 from hook 128 (e.g., by a defective or improperly latched latch mechanism 118), neither the operator's body nor hands would be susceptible to impact by rear door 112 or by any material M flowing out of cargo box 110.

Figure 13:
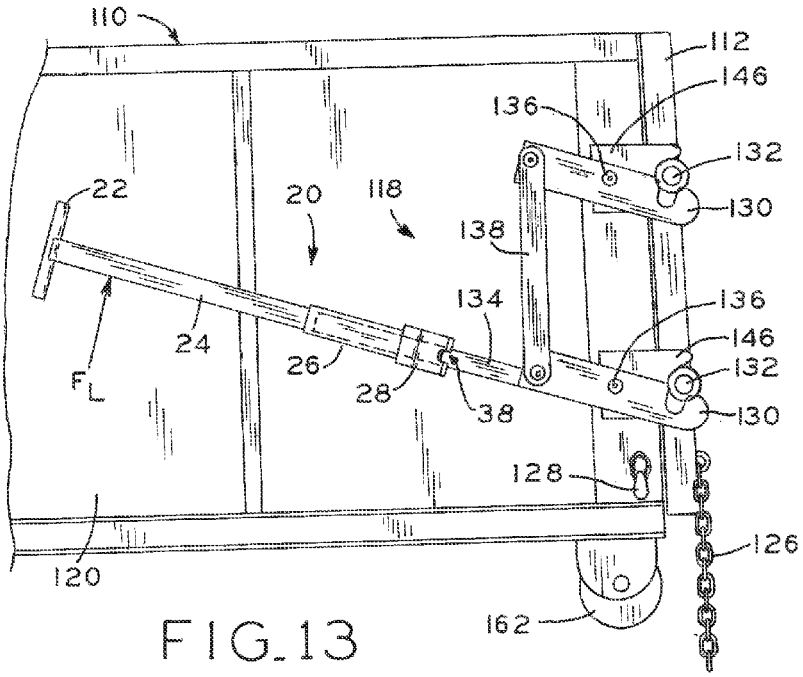
FIG. 13 is a side, elevation view of the cargo box shown in FIG. 8, illustrating use of the safety tool shown in FIG. 1 to facilitate disengagement of a latch mechanism.

With safety chains 126 and safety pins 122 now disengaged, latch mechanism 118 is the only remaining mechanism preventing rear door 112 from opening. When pressure on rear door 112 is present, such as where material M contained in cavity 114 is piled up on the inside face of door 112 (FIG. 8), a large amount of friction may be present between latch hooks 130 and latch bosses 132 (FIG. 13). In the illustrated embodiment of FIG. 13, lever 134 is provided as part of latch mechanism 118 to aid in the disengagement of latch hooks 130 from latch bosses 132. More particularly, lever 134 can be grasped by the operator and pivoted around pivot points 136 to simultaneously disengage latch hooks 130 (which are joined by linkage 138) of latch mechanism 118 from latch bosses 132. However, to provide mechanical advantage for such disengagement, the open distal end of distal tube 26 may be coupled with lever 134 as shown in FIG. 13. More particularly, lever 134 is passed into the internal cavity of distal tube 26 to rotationally couple safety tool 20 to lever 134 (and, ultimately, to latch hooks 130). Force $F_L$ may then be applied upon proximal tube 24 and/or handle 22 of safety tool 20, effectively increasing the length of lever 134 and providing additional mechanical advantage for disengagement of latch mechanism 118.

At this point in the process of opening door 112, the structures and mechanisms of cargo box 110 designed to maintain rear door in a closed position are all disengaged such that rear door 112 is free to pivot about door hinges 116. In some cases, however, friction between rear door 112 and surrounding structures of cargo box 110 may still prevent rear door 112 from pivoting to the open position of FIG. 9, even if material M has built up pressure behind rear door 112. Until rear door 112 is opened and any such pressure of material M is relieved, the operator cannot safely move away from sidewall 120 and toward the rear of dump truck 100.

Figure 14:
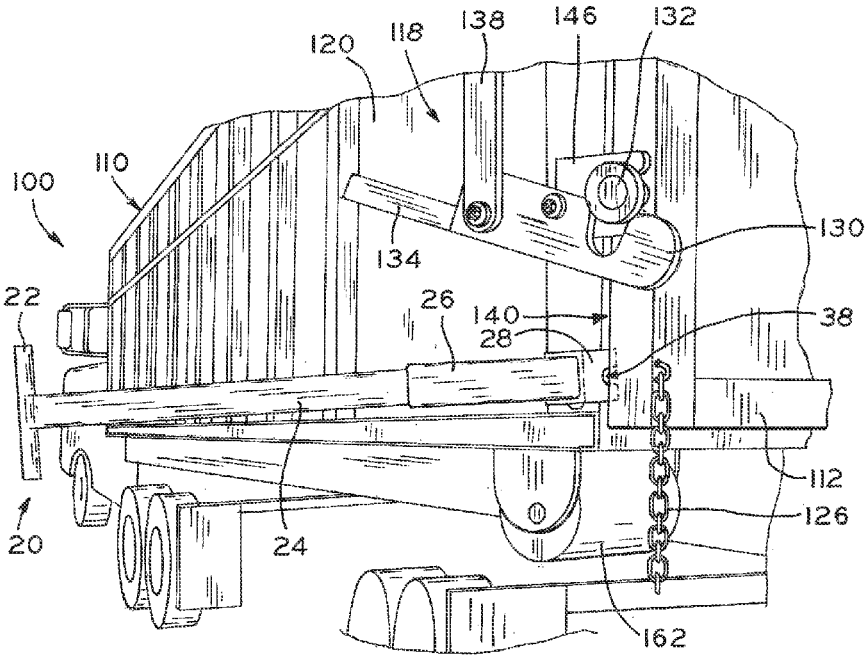
FIG. 14 is a rear, perspective view of a portion of the cargo box shown in FIG. 8, illustrating use of the safety tool shown in FIG. 1 to pry open the rear door of the cargo box.

In order to urge rear door 112 open in such a situation, without leaving the safe position near sidewall 120, safety tool 20 may be used as shown in FIG. 14. First, the distal edge of lever plate 28 is inserted into gap 140 formed between door 112 and sidewall 120. Taper 40 formed at the distal edge of lever plate 28 (FIG. 1) facilitates such insertion into gap 140 even if gap 140 is relatively small. Lever plate 28 should be inserted into gap 140 such that lever plate 28 faces forward toward the front of dump truck 100 and proximal and distal tubes 24, 26 face rearwardly toward the back of rear door 112. As noted above, angle a is formed by distal portion 32 of lever plate 28 with respect to axis A (FIGS. 4 and 5), which in turn causes proximal and distal tubes 24, 26 to be angled toward the front of dump truck 100 in the vicinity of sidewall 120. This angled arrangement of safety tool 20, facilitated by angle a, allows the operator to maintain his or her position near sidewall 120 and spaced away from the opening sweep of rear door 112 and any flow of material M from cargo box 110 upon opening of door 112. With safety tool 20 inserted into gap 140 as shown in FIG. 14, the operator can push upon handle 22 and/or proximal and distal tubes 24, 26 to lever open gap 140 via lever plate 28. In order to maximize leverage, the operator will naturally gravitate toward using handle 22 and the proximal end of proximal tube 24, which in turn also spaces the operator as far from rear door 112 as possible.

Figure 15:
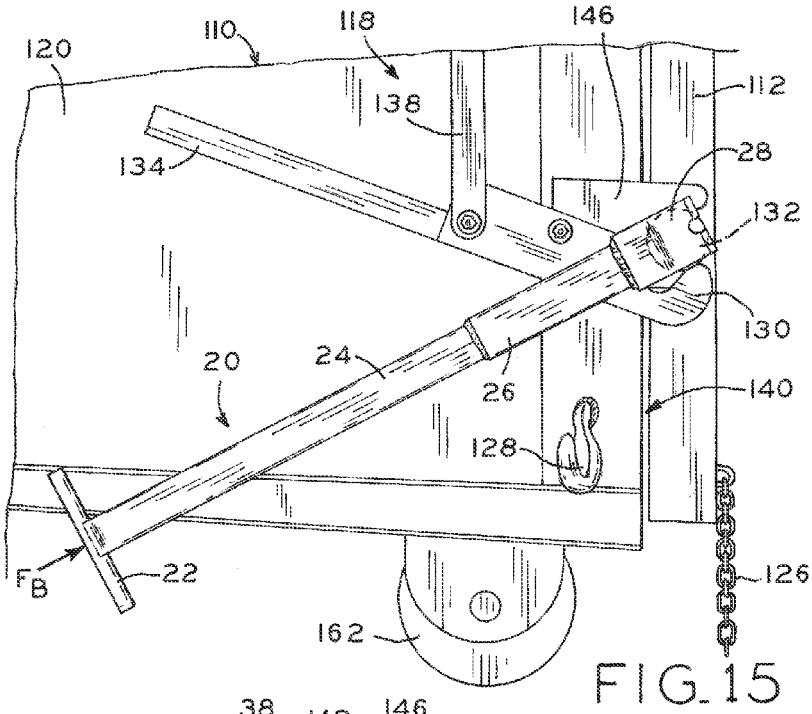
FIG. 15 is a side elevation view of a portion of the cargo box shown in FIG. 8, illustrating the use of the safety tool shown in FIG. 1 to provide an opening force upon the rear door of the cargo box.
Figure 16:
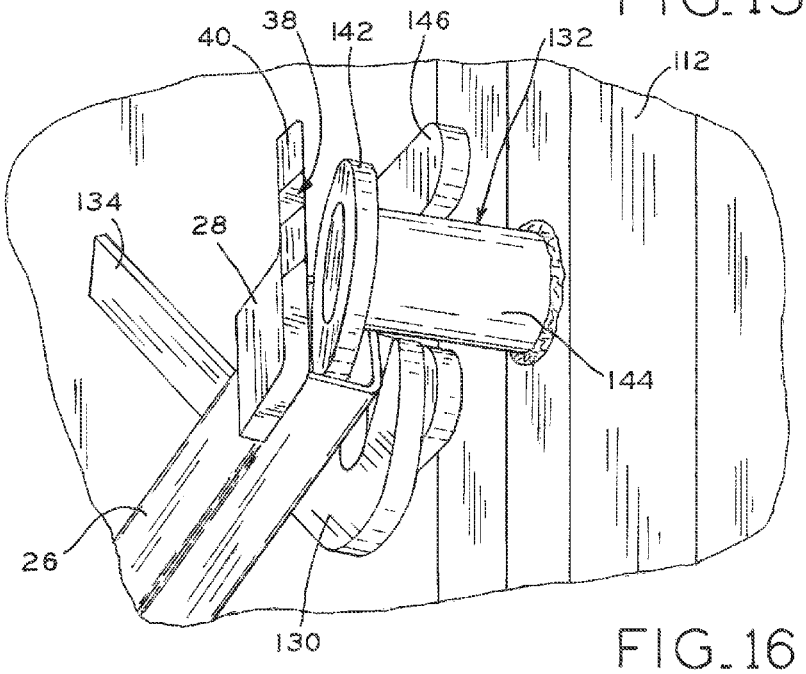
FIG. 16 is a rear, perspective view of the cargo box and safety tool shown in FIG. 15, illustrating engagement of the safety tool with a rear door structure.

The lever action shown in FIG. 14 may be sufficient to open rear door 112. However, if gap 140 has been opened as much as possible by safety tool 20 and rear door 112 remains stuck in a closed position, FIG. 15 illustrates how safety tool 20 can be used to apply additional force tending to open rear door 112 while keeping the operator in a safe zone near sidewall 120. The open end of distal tube 26 can be placed over lateral flange 142 formed at the end of latch boss 132, as best shown by FIG. 16. Lever plate 28 is positioned away from rear door 112, as illustrated, to prevent lever plate 28 from interfering with shaft 144 of latch boss 132. In this position, the operator can apply force $F_B$ to handle 22 along longitudinal axis A (FIGS. 3 and 4) either continuously or in a "hammering" motion. Force $F_B$ is efficiently transmitted to latch boss 132 via proximal and distal tubes 24, 26, while the partially-nested engagement between flange 142 and the open end of distal tube 26 prevents safety tool 20 from slipping off of or away from latch boss 132 during the operation. Force $F_B$ can be used to finally free rear door 112 from its closed position, all while the operator and his or her hands remain in the safe zone near sidewall 120 and safely spaced from rear door 112.

With rear door 112 now open, cargo box 110 can be elevated into the configuration of FIG. 9 and material M can be safely discharged from cavity 114 of cargo box 110 in accordance with standard procedures.

Figure 18:
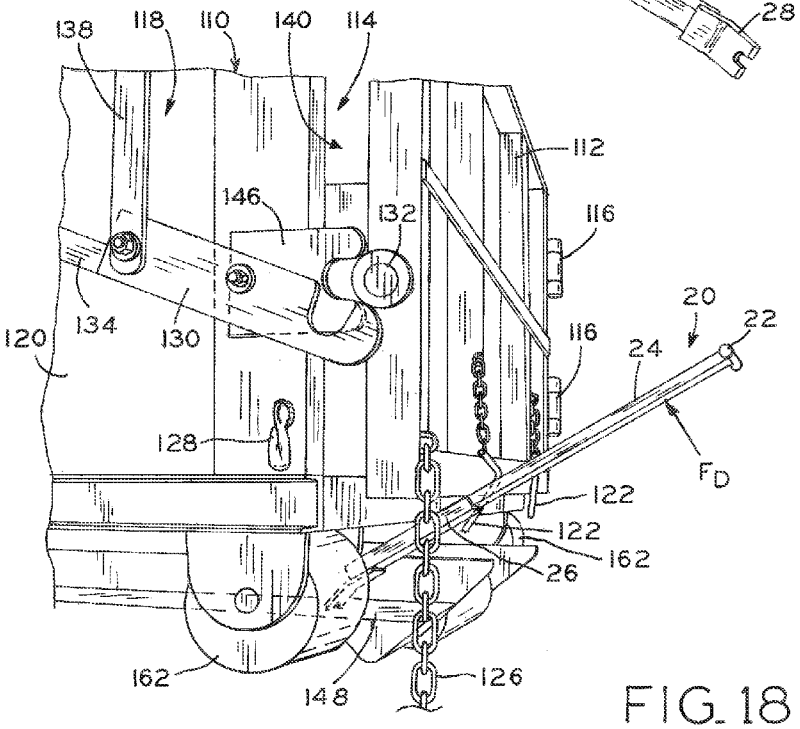
FIG. 18 is a rear, perspective view of a portion of the cargo box shown in FIG. 8, illustrating use of the safety tool shown in FIG. 1 to urge the rear door of the cargo box into a closed position.

When discharge of material M is complete and the operator desires to reconfigure rear door 112 into the closed position of FIG. 8, safety tool 20 may be used to aid in this process, as shown in FIG. 18. In some instances, especially over time, rear door 112 may lower or "sag" upon opening. Such sagging may result from the weight of door 112 deforming hinges 116, for example, or deforming the metal surrounding hinges 116. When such sagging occurs, latch boss 132 may not align properly with latch boss receiver 146 formed on sidewall 120 of cargo box 110 when the operator attempts to pivot door 112 shut. In effect, the door must be slightly lifted up during the closing operation, such that latch boss 132 and receiver 146 align and allow door 112 to be fully closed.

Safety tool 20 can be used for this purpose by positioning the distal edge of lever plate 28 upon an adjacent truck frame structure 148, as shown in FIG. 18. Proximal and/or distal tubes 24, 26 are then brought into contact with the lower edge of door 112, establishing the distal edge of lever plate 28 as a pivot point. Force $F_D$ is then applied to handle 22 and/or proximal tube 24 to apply both an upward lifting force and a forward closing force to door 112, helping to simultaneously align latch boss 132 with receiver 146 and pivot door 112 into the closed position. In many circumstances, the distance between lever plate 28 and the point of contact between tubes 24 or 26 with the lower edge of door 112 is less than the distance from such point of contact to handle 22, thereby providing a mechanical advantage in the closing of door 112. In an exemplary embodiment, the step-like junction between proximal and distal tubes 24, 26 can be engaged with the corresponding lower/rear edge of door 112, to further facilitate the lever action provided by safety tool 20.

Once door 112 is placed into the closed position, latch mechanism 118 may be re-engaged by lowering lever 134 in the opposite motion shown and described above with respect to FIG. 13. If necessary, safety tool 20 may be used to re-engage latch mechanism 118 by reversing the procedure of FIG. 13. Safety chain 126 may then be re-engaged with hook 128 in typical fashion, and pins may be reinserted through door 112 and pins blocks 124 to effect the final securement of door 112. Safety tool may be used as a blunt instrument to "hammer" or otherwise strike safety chain 126 and/or safety pins 122 as necessary.

Figure 17:
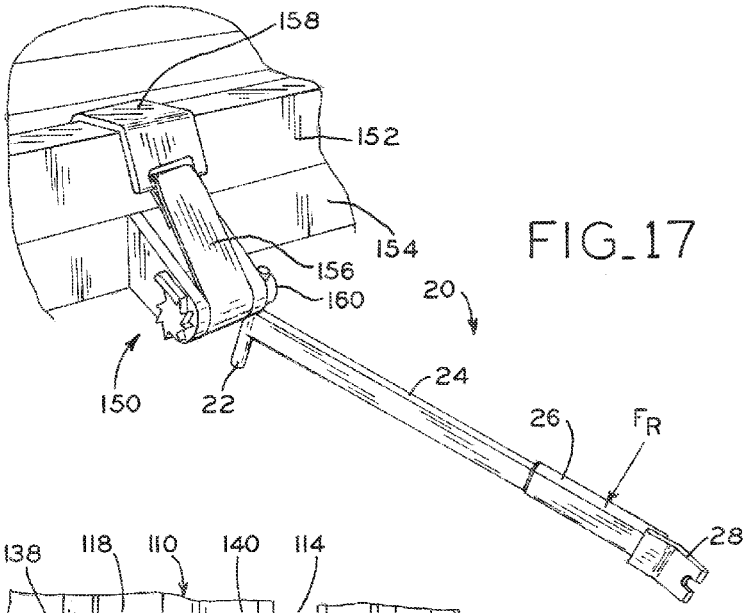
FIG. 17 is a rear, perspective view of a pull down mechanism used to secure the cargo box shown in FIG. 8 to the dump truck shown in FIG. 8, illustrating the use of the safety tool shown in FIG. 1 to manipulate the hold down mechanism.

Turning to FIG. 17, safety tool 20 has an additional use as a lever for manipulation of ratchet mechanism 150. Ratchet mechanism 150 may be used to secure frame member 152, located on the underside of cargo box 110, to frame member 154 which is part of dump truck 100. When so secured, cargo box 110 is prevented from lifting or pivoting away from its secured transport position shown in FIG. 8.

Ratchet mechanism 150 is affixed to truck frame member 154 as shown in FIG. 17, with ratchet strap 156 and hook 158 extending from ratchet mechanism 150. Hook 158 is sized to be secured to cargo box frame member 152, as shown. Ratchet mechanism 150 includes ratchet shaft 160, which rotates freely in one direction to tension strap 156, thereby pulling hook 158 firmly against cargo box frame member 152 and drawing frame member 152 firmly toward truck frame member 154. Shaft 160 is prevented from rotating in the other direction by ratchet mechanism 150 unless catch 164 is released.

Ratchet shaft 160 can drive mechanism 150 in the free-spinning direction, and includes a transverse bore formed therethrough for receipt of a lever to provide driving torque. To facilitate the use of safety tool 20 as this lever, handle 22 can be sized to fit within the transverse bore of ratchet shaft 160 as illustrated in FIG. 17. With handle 22 so received, force $F_R$ can be applied to one of tubes 22, 26 or to handle 22, thereby providing torque to ratchet shaft 160. The overall length of handle safety tool 20 offers a substantial mechanical advantage in tightening or otherwise manipulating ratchet mechanism 150.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A method of safely manipulating a door of a cargo box through the use of a safety tool, the method comprising:

rotatably affixing the safety tool to a lever of a latch mechanism by passing an open distal end of the safety tool over the lever, the latch mechanism operable to prevent or allow opening of the door based on a pivotal configuration of the lever;

disengaging the latch mechanism from the door by pivoting the lever of the latch mechanism via the safety tool, the step of disengaging accomplished with a user of the safety tool spaced from the sweep of the door and from a direction of potential flow of material outwardly from the cargo box via the door;

inserting a distal edge of a lever plate disposed at a distal end of the safety tool into a gap between the door and a sidewall of the cargo box, such that the safety tool extends away from the gap along a direction opposed to the sweep of the door; and levering the door toward an open position by applying a force to the safety tool, the step of levering accomplished with the user of the safety tool spaced from the sweep of the door and from the direction of potential flow of material outwardly from the cargo box via the door, wherein the cargo box includes a pin receivable within bores formed in the door and the cargo box near the door, such that the pin prevents pivoting of the door between open and closed positions when the pin is received in the bores, the method further comprising disengaging the pin from at least one of the bores by the steps of:

inserting the lever plate between an L-shaped portion of the pin and an adjacent substantially horizontal surface of the door;

receiving a shaft of the pin within a notch formed in the distal, leading edge of the lever plate; and applying a force to the safety tool such that the distal, leading edge of the lever plate is advanced along a direction of removal of the pin and urges the pin along the direction of removal.

2. The method of claim 1, wherein the step of inserting the lever plate is performed by initially inserting a tapered distal edge of the lever plate between the L-shaped portion of the pin and the adjacent substantially horizontal surface of the door.

3. The method of claim 1, further comprising disengaging a safety chain extending from the door to the sidewall of the cargo box, the safety chain affixable to a safety chain hook disposed on the sidewall to prevent the door from pivoting to its open position, said step of disengaging the safety chain comprising:

engaging the notch formed in the distal, leading edge of the lever plate with a link of the safety chain in the vicinity of the safety chain hook such that the engaged safety chain link is at least partially captured by the lever plate; and applying a chain disengagement force in a generally upward and rearward direction to dislodge the safety chain from the safety chain hook, the step of applying the chain disengagement force accomplished with the user of the safety tool spaced from the sweep of the door and from the direction of potential flow of material outwardly from the cargo box via the door.

4. The method of claim 3, wherein said step of engaging the notch comprises:

grasping the safety tool by a handle connected to the safety tool at a proximal end thereof, the handle having a longitudinal axis substantially perpendicular to an overall longitudinal axis of the safety tool; and grasping a main body of the safety tool along the overall longitudinal axis.

5. The method of claim 1, wherein said step of disengaging the latch mechanism further comprises:

coupling the open distal end of the safety tool to the lever by receiving the lever within an internal cavity formed by a tubular structure forming a main body of the safety tool; and applying a force to one of the tubular structure and a handle fixed to a proximal end of the tubular structure to pivot the lever of the latch mechanism toward its open position with the aid of mechanical advantage conferred by the safety tool.

6. The method of claim 1, wherein said step of levering the door toward an open position further comprises:

inserting a tapered distal edge of the lever plate into the gap such that an angle formed between an outer surface of the door and a longitudinal axis of the safety tool is approximately equal to an angle formed between a distal portion and a proximal portion of the lever plate; and pushing upon the safety tool toward the door to lever open the gap.

7. The method of claim 6, wherein said step of pushing upon the safety tool comprises pushing upon a handle disposed at a proximal end of the safety tool to thereby maximize mechanical advantage.

8. The method of claim 1, further comprising:

engaging the open distal end of the safety tool with a latch boss formed on the side of the door, the latch boss positioned to cooperate with the latch mechanism to selectively prevent or allow opening of the door, such that the step of engaging the open distal end spaces the user of the safety tool from the sweep of the door and from the direction of potential flow of material outwardly from the cargo box via the door; and applying a force to the latch boss via the safety tool to urge the door into an open position, the step of applying a force accomplished with the user of the safety tool spaced from the sweep of the door and from the direction of potential flow of material outwardly from the cargo box via the door.

9. The method of claim 8, wherein:

said step of engaging the open distal end of the safety tool with the latch boss comprises placing the open distal end of the safety tool over a lateral flange formed at an end of the latch boss such that the lateral flange is partially nested in the open distal end, whereby the open distal end of the safety tool is inhibited from slipping off of or away from the latch boss during said step of applying a force to the latch boss.

10. The method of claim 1, further comprising closing the door using the safety tool by the steps of:

positioning the distal edge of the lever plate upon a truck frame structure proximate the door;

bringing a main body of the safety tool into contact with a lower edge of the door to thereby establish the distal edge of the lever plate as a pivot point; and applying a force to the main body of the safety tool to apply both an upward lifting force and a forward closing force to the door, thereby urging the latch mechanism into alignment for engagement while also pivoting the door into a closed position.

11. The method of claim 10, wherein a point of contact between the main body of the safety tool and the lower edge of the door is positioned such that a first lever distance is established between the point of contact and the distal edge of the lever plate and a second lever distance is established between the point of contact and a proximal end of the main body of the safety tool, the first lever distance less than the second lever distance such that the safety tool provides a mechanical advantage in the closing of the door.

12. The method of claim 1, further comprising manipulating a ratchet mechanism with the safety tool by the steps of:

fitting a handle attached to a proximal end of the safety tool into a transverse bore of a ratchet shaft, the ratchet shaft operably coupled to the ratchet mechanism such that the ratchet shaft can actuate the ratchet mechanism; and applying a force to a main body of the safety tool such that a torque is provided to the ratchet shaft, whereby a substantial mechanical advantage is provided for tightening or otherwise manipulating the ratchet mechanism.

13. A method of safely manipulating a door of a cargo box through the use of a safety tool, the method comprising:

rotatably affixing the safety tool to a lever of a latch mechanism by passing an open distal end of the safety tool over the lever, the latch mechanism operable to prevent or allow opening of the door based on a pivotal configuration of the lever;

disengaging the latch mechanism from the door by pivoting the lever of the latch mechanism via the safety tool, the step of disengaging accomplished with a user of the safety tool spaced from the sweep of the door and from a direction of potential flow of material outwardly from the cargo box via the door;

inserting a distal edge of a lever plate disposed at a distal end of the safety tool into a gap between the door and a sidewall of the cargo box, such that the safety tool extends away from the gap along a direction opposed to the sweep of the door;

levering the door toward an open position by applying a force to the safety tool, the step of levering accomplished with the user of the safety tool spaced from the sweep of the door and from the direction of potential flow of material outwardly from the cargo box via the door; and disengaging a safety chain extending from the door to the sidewall of the cargo box, the safety chain affixable to a safety chain hook disposed on the sidewall to prevent the door from pivoting to its open position, said step of disengaging the safety chain comprising:

engaging a notch formed in a distal, leading edge of the lever plate with a link of the safety chain in the vicinity of the safety chain hook such that the engaged safety chain link is at least partially captured by the lever plate; and applying a chain disengagement force in a generally upward and rearward direction to dislodge the safety chain from the safety chain hook, the step of applying the chain disengagement force accomplished with the user of the safety tool spaced from the sweep of the door and from the direction of potential flow of material outwardly from the cargo box via the door.

14. The method of claim 13, wherein said step of engaging the notch comprises:

grasping the safety tool by a handle connected to the safety tool at a proximal end thereof, the handle having a longitudinal axis substantially perpendicular to an overall longitudinal axis of the safety tool; and grasping a main body of the safety tool along the overall longitudinal axis.

15. The method of claim 13, wherein said step of disengaging the latch mechanism further comprises:

coupling the open distal end of the safety tool to the lever by receiving the lever within an internal cavity formed by a tubular structure forming a main body of the safety tool; and applying a force to one of the tubular structure and a handle fixed to a proximal end of the tubular structure to pivot the lever of the latch mechanism toward its open position with the aid of mechanical advantage conferred by the safety tool.

16. The method of claim 13, wherein said step of levering the door toward an open position further comprises:

inserting a tapered distal edge of the lever plate into the gap such that an angle formed between an outer surface of the door and a longitudinal axis of the safety tool is approximately equal to an angle formed between a distal portion and a proximal portion of the lever plate; and pushing upon the safety tool toward the door to lever open the gap.

17. The method of claim 16, wherein said step of pushing upon the safety tool comprises pushing upon a handle disposed at a proximal end of the safety tool to thereby maximize mechanical advantage.

18. The method of claim 13, further comprising:

engaging the open distal end of the safety tool with a latch boss formed on the side of the door, the latch boss positioned to cooperate with the latch mechanism to selectively prevent or allow opening of the door, such that the step of engaging the open distal end spaces the user of the safety tool from the sweep of the door and from the direction of potential flow of material outwardly from the cargo box via the door; and applying a force to the latch boss via the safety tool to urge the door into an open position, the step of applying a force accomplished with the user of the safety tool spaced from the sweep of the door and from the direction of potential flow of material outwardly from the cargo box via the door.

19. The method of claim 18, wherein:

said step of engaging the open distal end of the safety tool with the latch boss comprises placing the open distal end of the safety tool over a lateral flange formed at an end of the latch boss such that the lateral flange is partially nested in the open distal end, whereby the open distal end of the safety tool is inhibited from slipping off of or away from the latch boss during said step of applying a force to the latch boss.

20. The method of claim 13, further comprising closing the door using the safety tool by the steps of:

positioning the distal edge of the lever plate upon a truck frame structure proximate the door;

bringing a main body of the safety tool into contact with a lower edge of the door to thereby establish the distal edge of the lever plate as a pivot point; and applying a force to the main body of the safety tool to apply both an upward lifting force and a forward closing force to the door, thereby urging the latch mechanism into alignment for engagement while also pivoting the door into a closed position.

21. The method of claim 20, wherein a point of contact between the main body of the safety tool and the lower edge of the door is positioned such that a first lever distance is established between the point of contact and the distal edge of the lever plate and a second lever distance is established between the point of contact and a proximal end of the main body of the safety tool, the first lever distance less than the second lever distance such that the safety tool provides a mechanical advantage in the closing of the door.

22. The method of claim 13, further comprising manipulating a ratchet mechanism with the safety tool by the steps of:

fitting a handle attached to a proximal end of the safety tool into a transverse bore of a ratchet shaft, the ratchet shaft operably coupled to the ratchet mechanism such that the ratchet shaft can actuate the ratchet mechanism; and applying a force to a main body of the safety tool such that a torque is provided to the ratchet shaft, whereby a substantial mechanical advantage is provided for tightening or otherwise manipulating the ratchet mechanism.

23. The method of claim 13, wherein the cargo box includes a pin receivable within bores formed in the door and the cargo box near the door, such that the pin prevents pivoting of the door between open and closed positions when the pin is received in the bores, the method further comprising disengaging the pin from at least one of the bores by the steps of:

inserting the lever plate between an L-shaped portion of the pin and an adjacent substantially horizontal surface of the door;

receiving a shaft of the pin within the notch formed in the distal, leading edge of the lever plate; and applying a force to the safety tool such that the distal, leading edge of the safety tool is advanced along a direction of removal of the pin and urges the pin along the direction of removal.

24. The method of claim 23, wherein the step of inserting the lever plate is performed by initially inserting a tapered distal edge of the lever plate between the L-shaped portion of the pin and the adjacent substantially horizontal surface of the door.

* * * * *